United States Patent [19]

Misevich

[11] Patent Number: 4,561,197

[45] Date of Patent: Dec. 31, 1985

[54] GOLF SHOE SOLE STRUCTURES FOR RELIEVING SPIKE-PRODUCED PRESSURE POINTS

[75] Inventor: Kenneth W. Misevich, Fairfield, Conn.

[73] Assignee: Colgate-Palmolive Company, New York, N.Y.

[21] Appl. No.: 730,040

[22] Filed: May 3, 1985

Related U.S. Application Data

[63] Continuation of Ser. No. 525,027, Aug. 22, 1983, abandoned.

[51] Int. Cl.[4] ..... A43B 5/00

[52] U.S. Cl. ..... 36/127; 36/134; 36/28; 36/67 A

[58] Field of Search ..... 36/114, 126, 127, 128, 36/129, 134, 28, 31, 67 A, 7.6, 7.7, 95, 88, 96

[56] References Cited

U.S. PATENT DOCUMENTS

| | | | |
|---|---|---|---|
| 2,082,537 | 6/1937 | Butler | 36/28 X |
| 2,405,443 | 8/1946 | Mees | 36/30 R |
| 3,086,301 | 4/1963 | Pastor | 36/88 |
| 3,559,308 | 2/1971 | Bernier et al. | 36/67 A X |
| 4,043,058 | 8/1977 | Hollister et al. | 36/28 X |
| 4,168,585 | 9/1979 | Glackner | 36/95 |
| 4,377,041 | 3/1983 | Alchermes | 36/31 X |

FOREIGN PATENT DOCUMENTS

| | | | |
|---|---|---|---|
| 1176467 | 4/1959 | France | 36/114 |
| 1426358 | 12/1965 | France | 36/134 |
| 298925 | 10/1928 | United Kingdom . | |

*Primary Examiner*—Henry S. Jaudon
*Assistant Examiner*—T. Graveline
*Attorney, Agent, or Firm*—LeBlanc, Nolan, Shur & Nies

[57] ABSTRACT

A golf shoe or other spiked shoe having spike receptacles embedded in the shoe's outsole and an intermediate sole overlying the outsole and configured to relieve the spike-produced pressure points or zones which result from walking or standing on a hard surface.

16 Claims, 8 Drawing Figures

GOLF SHOE SOLE STRUCTURES FOR RELIEVING SPIKE-PRODUCED PRESSURE POINTS

This is a continuation of application Ser. No. 525,027 filed Aug. 22, 1983, abandoned 05/03/85.

FIELD OF INVENTION

This invention relates to golf shoes and other types of shoes have ground-engaging spikes.

BACKGROUND

In various present day golf shoes, the ground-engaging spikes are fastened in receptacles which are embedded in the shoe's outsole underlying an intermediate sole such as a foamed shock-absorbing midsole. In some shoes of this type, the outsole is formed with a relatively thin ground-engaging base portion to enhance the flexibility of the shoe, and the spike receptacles are embedded or encapsulated in raised cap-like capsule portions which are integral with and disposed on the upper side of the outsole's base portion to interface with the overlying, shock-absorbing intermediate sole. Because of this construction, the spikes exert discomforting, highly localized pressure points on the wearer's foot when the wearer is walking on hard ground or other hard surfaces.

SUMMARY AND OBJECTS OF INVENTION

The general aim and purpose of this invention is to provide a novel sole structure which relieves the spike-produced pressure points or which otherwise causes the pressure points to disappear.

A more specific object of this invention is to provide a golf shoe or other spiked shoe with a novel sole structure which relieves the spike-produced pressure points without diminishing the flexibility and cushioning properties of the shoe and without causing any other discomfort as a result to modifying the sole structure to relieve the pressure points.

In the illustrated embodiments, the foregoing objective is achieved mainly by providing unfilled holes or voids in the overlying midsole or intermediate sole vertically above the outsole's raised, spike receptacle capsule portions. Upon compressively loading the midsole, the raised capsule portions are at least partially received in the empty holes without creating any localized compression of the midsole centrally of the capsule portions, thus relieving the pressure points which would otherwise develop while walking on hard surfaces. In this specification, the above-mentioned holes or voids are considered to be empty or unfilled in the sense that while they may contain air or possibly some other gas, they do not contain any solid substance.

The holes in the golf shoe's midsole are required to be large enough to eliminate or at least relieve the spike-produced pressure points, but not so large that they are felt by the wearer through the shoe's insole board.

In the illustrated embodiments, the raised capsule portions are tapered, and the midsole holes have uniform diameters which are at least as large as the diameters of the reduced diametered end faces of the capsule portions, but smaller than the base diameters of the capsule portions so that the lower edges of the midsole holes are precompressed against the sloped side walls of the capsule portions in the fabrication of the shoe. The tapered configuration of the capsule portions permits the midsole holes to be made small enough so that they will not be felt by the wearer, but yet large enough to relieve the spike-produced pressure points. The sloped side walls of the capsule portions are preferably set at a shallow angle so that large midsole areas around the holes will be precompressed against the sloped side walls to spread the forces which develop upon loading the shoe's spikes.

The midsole may be a one-piece foamed structure. Alternatively, it may be a two-piece foamed structure having upper and lower layers. The upper midsole layer is made soft enough to amply meet the wearer's comfort requirements. The lower layer defines the midsole holes and advantageously has a stiffness significantly greater than the stiffness of the upper layer, but less than the stiffness of the outsole. As compared with the one-piece midsole construction, the lower, stiffer midsole layer in the two-piece midsole provides a greater reduction in the spike-produced pressure zones by more uniformly distributing the compressive forces acting on the midsole due to the loading of the spikes.

Preferably, the stiffnesses of the upper and lower midsole layers are so selected that the sum of their stiffnesses or effective spring rates equals or at least approximately equals the sum of the stiffnesses or effective spring rates of any given one of the outsole's raised capsule portions and the upper midsole layer, so that the overall stiffness of the midsole/outsole structure is at least approximately uniform.

Further objects of this invention will appear as the description proceeds in connection with the below-described drawings and the annexed claims.

DETAILED DESCRIPTION

Figure 1:
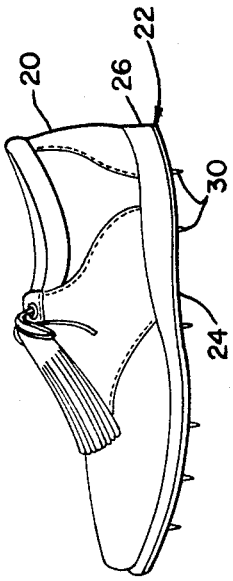
FIG. 1 is a perspective view of a left foot golf shoe incorporating the principles of this invention.

Referring to FIG. 1, a left-foot golf shoe incorporating the principles of this invention is shown to comprise an upper 20 and a shoe bottom 22. Upper 20 may be of any suitable conventional construction.

Figure 2:
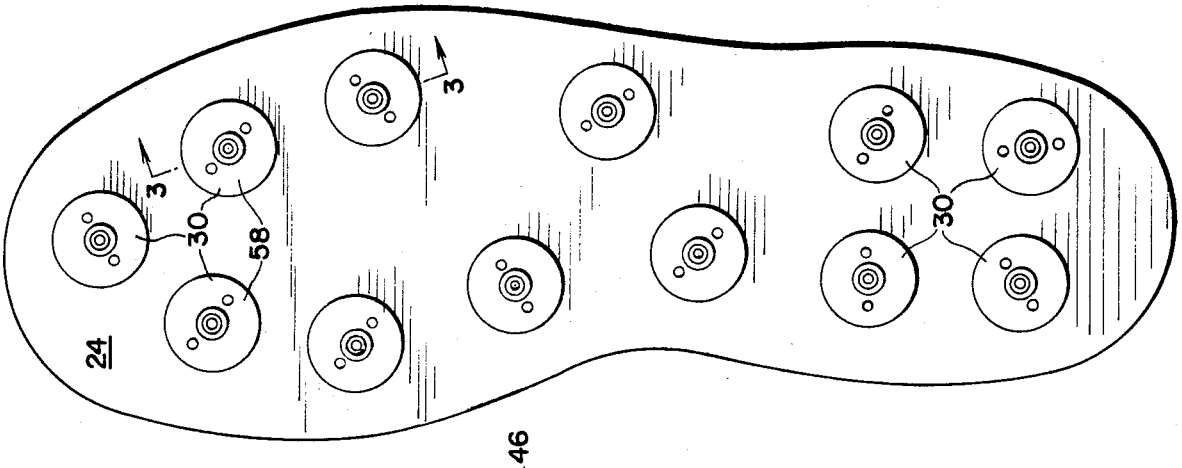
FIG. 2 is a bottom plan view of the golf shoe shown in FIG. 1.
Figure 3:
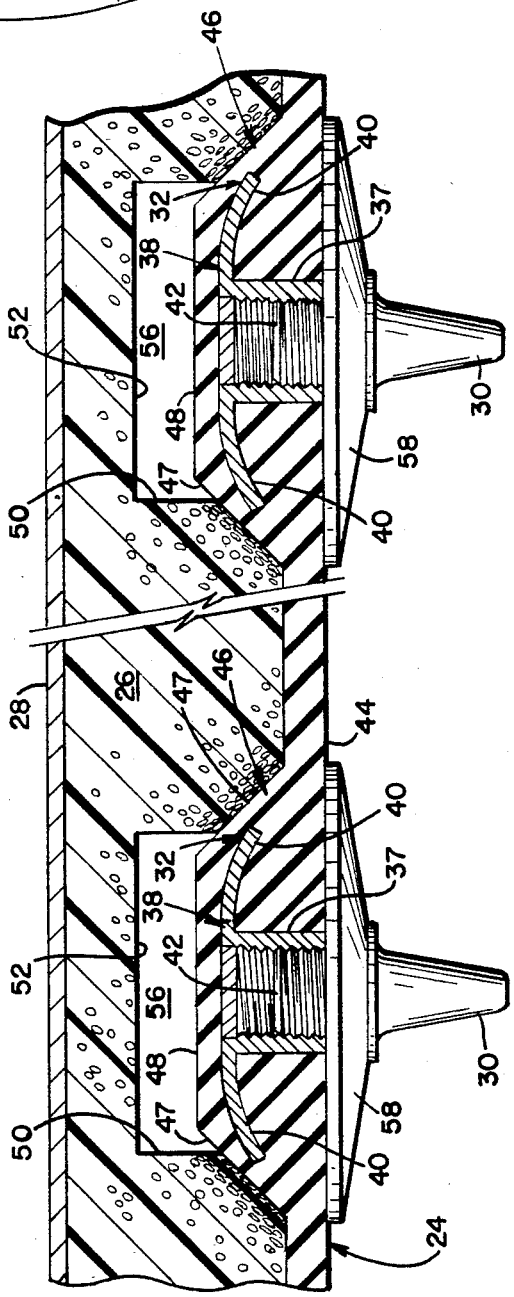
FIG. 3 is an enlarged, fragmentary section taken substantially along lines 3—3 of FIG. 2.
Figure 4:
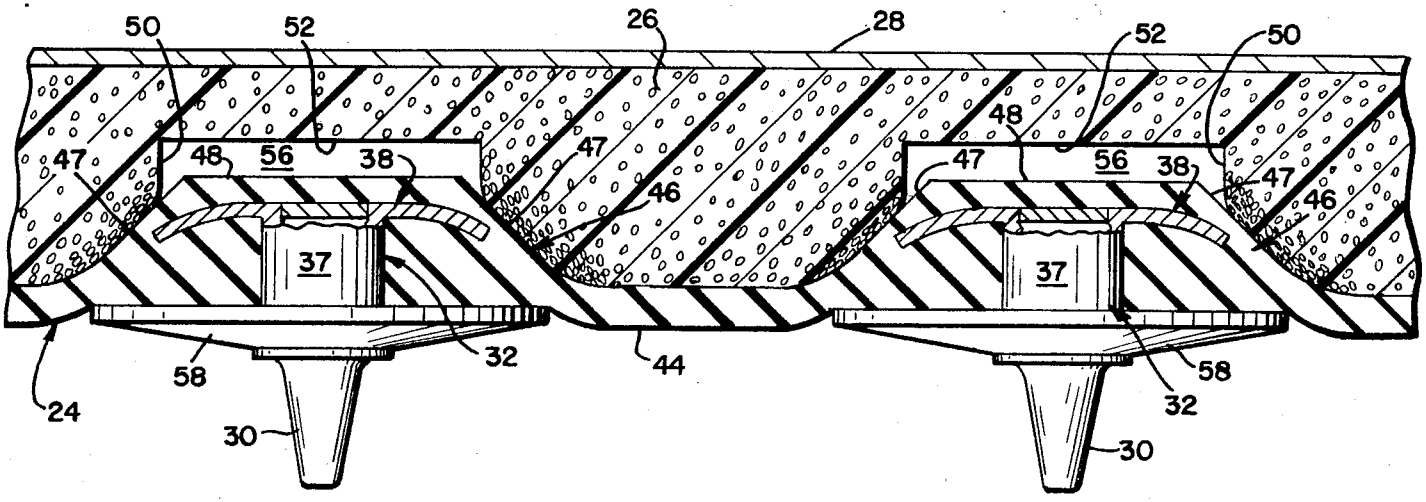
FIG. 4 is a section similar to FIG. 3, but showing the sole structure in its compressively loaded state, as when the wearer is walking on a hard surface.

As shown in FIG. 3, the shoe bottom comprises a flexible outsole 24, a shock-absorbing intermediate sole 26 (or midsole, as it may be called) overlying and bonded or otherwise fixed to outsole 24, and an insole board 28 overlying and bonded or otherwise fixed to the generally flat upper surface of midsole 26. Outsole 24 is equipped with a set of ground-engaging spikes 30 which are spaced apart in a suitable pattern (see FIG. 2)

for enhancing the wearer's traction on turf or other relatively soft ground surface. Spikes 30 are removably secured in spike receptacles 32 (see FIG. 3) which are embedded in outsole 24.

Spike receptacles 32 may be of any suitable construction. In the embodiment shown in FIG. 3, each receptacle comprises an internally threaded sleeve 37 and an anchoring flange or member 38 fixed to the upper end of sleeve 37 and having a set of angularly spaced apart radially extending ears 40 embedded in outsole 24 to securely anchor the receptacle in the outsole. Spikes 30 have threaded stems 42 which are threaded into the spike receptacle sleeves 37 to removably secure the spikes to their receptacles.

Still referring to FIG. 3, outsole 24 is advantageously molded or otherwise fabricated in one piece from synthetic or natural rubber material. Outsole 24 is integrally formed with a ground-engaging base portion 44 and a set of spaced apart, raised, cap-like spike receptacle capsule portions 46. Base portion 44 extends the full length of the shoe, and capsule portions are integral with base portion 44 and project upwardly from the upper flat surface of base portion 44 to encapsulate the upper portions of receptacles 32, including anchoring flange 38.

Because of capsule portions 46, base portion 44 is not required to be thicker than the axial lengths of spike receptacles 32. Base portion 44 may therefore be made relatively thin to enhance the flexibility of the shoe.

In the embodiment shown in FIG. 3, each capsule portion 46 has a tapered configuration and is formed with a sloped side wall 47 which is contained in a conical envelope and which extends upwardly from an enlarged base at the upper surface of base portion 44 to a smaller diametered, flat end face 48. Spike receptacles 32 are located centrally of their associated capsule portions 46 so that the longitudinal axes of receptacles 32 align with the longitudinal axes of capsule portions 46. Additionally, spikes 30 axially align with spike receptacles 32 as shown in FIG. 3.

In the embodiment shown in FIG. 3, midsole 26 is formed as one piece from any suitable, preferably closed cell polymeric foamed shock-absorbing material. Midsole 26 is formed with a set of parallel, spaced apart, downwardly opening holes 50 vertically overlying and receiving capsule portions 46 to relieve spike-produced pressure points or zones. Each midsole hole is located to receive a different capsule portion 46 and axially aligns with its associated capsule portion as shown.

Holes 50 may be provided with any suitable configuration. In the embodiment shown in FIG. 3, holes 50 are cylindrical and may be molded in midsole 26. Alternatively, they may be bored or punched out of the midsole.

In the embodiment shown in FIG. 3, holes 50 extend only partially through midsole 26 and terminate at their upper ends in flat end faces 52 at a level intermediate the upper and lower midsole surfaces. Alternatively, holes 50 may be formed completely through midsole 26 to open at the upper and lower midsole surfaces as shown in FIG. 9. In the embodiment shown in FIG. 9, the upper ends of holes 50 are closed by solid, cylindrical plugs 54.

Referring back to FIG. 3, holes 50 are uniformly dimensioned. Likewise, capsule portions 46 are also uniformly dimensioned and therefore have a common height which is significantly smaller than the common length or height of holes 50. Except for the presence of air, holes 50 are unfilled and therefore define empty spaces 56 immediately vertically above capsule portions 46.

The sizes of holes 50 is required to be large enough to adequately relieve the spike-produced pressure points, but yet small enough so as not to be felt by the wearer through insole board 28. Additionally, the size of holes 50 is required to be at least as large as the diameter of end faces 48. Preferably, the diameter of holes 50 is somewhat greater than the end face diameter of capsule portions 46, but smaller than the base diameter of capsule portions 46.

In the illustrated embodiments each capsule portion 46 has a diameter of 0.6 inch at its end face 48 and a diameter of 0.92 inch at its base. The diameter of holes 50 is in the range extending from 0.60 inch or 0.92 inch and is preferably about 0.75 inch.

As shown in FIG. 3, a spike flange 58 is fixed to each spike and has holes or notches which are engageable by a wrench or tool for removing the spike from its receptacle. Preferably, the base diameter of each capsule portion 46 is equal to or at least equal to the diameter of flange 58.

Figure 5:
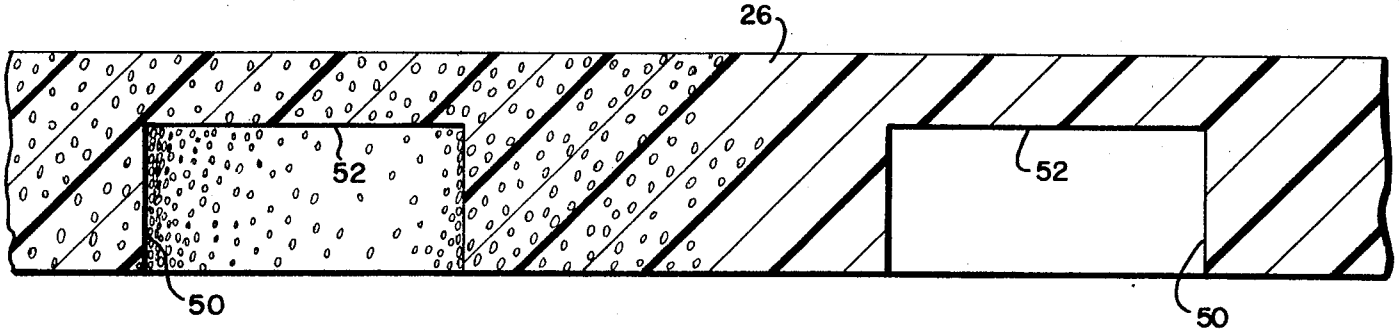
FIG. 5 is a sectional view of the midsole showing the midsole in its uncompressed state prior to assembly with the outsole.

In the relaxed, uncompressed state of midsole 26 shown in FIG. 5, the bottom edge of each hole 50 defines a 90 degree corner in cross section. Upon assembly of midsole 26 with outsole 24, the midsole's bottom surface will seat against the upper surface of base portion 44, and the bottom edges of holes 50 will be compressed against and conformed to the configuration of the sloped side walls 47. The angle which each side wall 47 makes with the horizontal in cross section is shallow (about 30 degrees) so that large midsole areas around holes 50 will be precompressed against side walls 47 in the fabrication of the shoe to spread and more uniformly distribute the forces acting upon midsole 26 as a result of loading spikes 30. It will be appreciated that the greater the precompressed midsole area around holes 50, the more uniform the force distribution will be.

Without holes 50, localized zones of midsole 26 located centrally of receptacles 32 would be compressed to a significantly greater extent than the remainder of the midsole to exert pressure points on the wearer's foot when the wearer is walking or standing on a hard surface. With holes 50, however, capsule portions 46 will rise relative to the wearer's foot or insole board 28 into spaces 56 when the midsole is compressed under the wearer's load. As a result, end faces 48 will not engage and compress the midsole upon loading spikes 30 and therefore will not create any localized pressure points or zones. In this manner, the unique configuration of midsole 26 relieves the pressure points or zones due to the loading of spikes 30, making the shoe more comfortable for walking on hard surfaces without diminishing the flexibility and cushioning properties of the shoe and without causing any other discomforture due to the midsole configuration.

Figure 6:
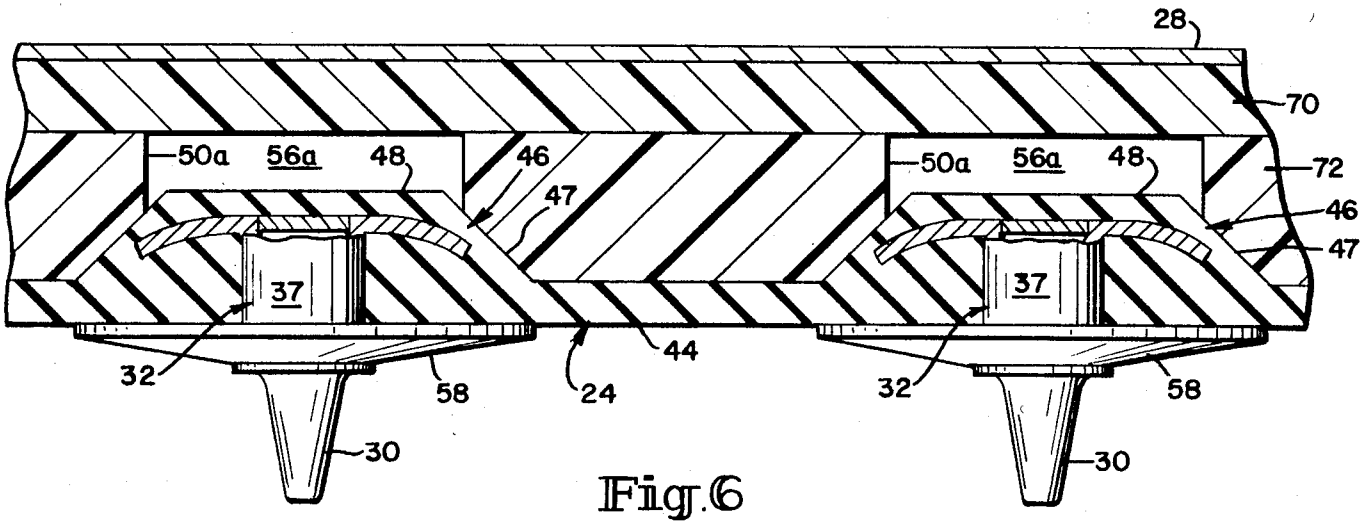
FIG. 6 is a section similar to FIG. 3, but showing another embodiment of this invention in which the midsole is a two-piece structure.
Figure 7:
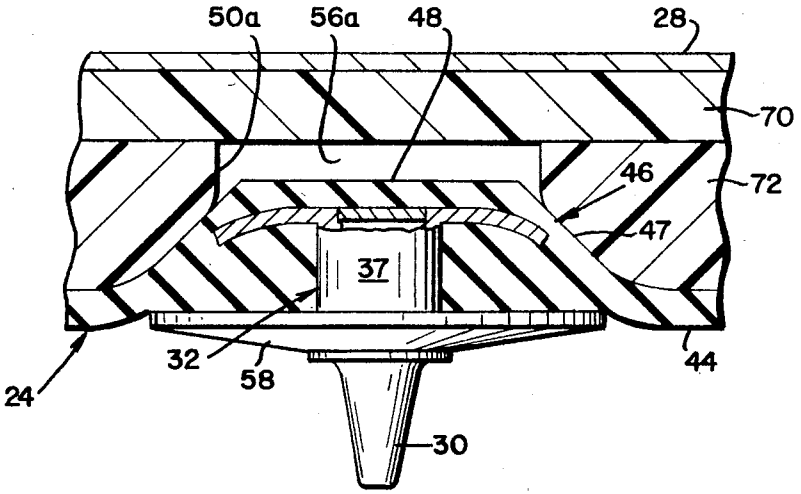
FIG. 7 is a section similar to FIG. 6, but showing the sole structure in its compressively loaded state as when the wearer is walking on a hard surface.

The embodiment shown in FIG. 6 is the same as that shown in FIG. 3 except that the one-piece midsole is replaced with a two-piece, foamed midsole having an upper layer 70 and a lower layer 72 formed separately of the upper layer. To the extent that the embodiments shown in FIGS. 3 and 6 are alike, like reference numerals have been used to identify like parts. Each of the midsole layers 70 and 72 is formed from a compressible, foamed polymeric material which is preferably of the closed cell type.

Midsole holes 50*a* corresponding to holes 50 are formed completely through the lower midsole layer 72, but not the upper midsole layer 70. Holes 50*a* axially align with and are immediately vertically above the outsole's raised capsule portions 46. Like holes 50, the common diameter of holes 50*a* is at least equal to the 0.60 inch diameter of end faces 48 and preferably greater than the end face diameter of capsule portions 46 but smaller than the base diameter of the capsule portions. The preferred diameters of holes 50 and 50*a* are the same. The lower edges of holes 50*a* will therefore be precompressed against the sloped side walls 47 of capsule portions 46 similar to the embodiment shown in FIG. 3. The bottom face of the lower midsole layer 72 seats against and is adhered to the upper surface of base portion 44, the lower flat bottom surface of the upper midsole layer 70 seats against and is adhered to the upper flat surface of the lower midsole layer 72, and insole board 28 may be adhered to the upper flat surface of the upper midsole layer 70.

From the foregoing construction, it will be appreciated that the upper midsole layer 70 overlies and closes the upper open ends of holes 50*a*. Like the embodiment in FIG. 3, holes 50*a* are unfilled to thereby define empty spaces 56*a*.

The upper midsole layer 70 is made soft enough to amply meet the wearer's comfort requirements. The lower midsole layer 72 is preferably stiffer than the upper midsole layer 70 but not as stiff as outsole 24. Because of its increased stiffness, the flexure of layer 72 will be less abrupt under the influence of forces acting axially on spikes 30. The increased stiffness of layer 72 therefore acts to more uniformly distribute such forces on the midsole, thereby more greatly relieving the spike-produced pressure zones.

Preferably, the stiffnesses of the upper and lower midsole layers 70 and 72 are so selected that the sum of their stiffness equals or at least approximately equals the sum of the stiffnesses of the upper midsole layer 70 and the common stiffness of capsule portions 46, so that the overall stiffness of the midsole/outsole structure is at least approximately uniform.

Like the embodiment of FIG. 3, capsule portions 46 will rise relative to the wearer's foot into the empty spaces created by holes 50*a* when the midsole is compressed under the wearer's load. As a result, the end faces 48 of capsule portions 46 will not engage and compress any portion of the midsole upon loading spikes 30 and therefore will not create any localized pressure zones centrally of spikes 30 or anywhere else in the region of end faces 48.

Figure 8:
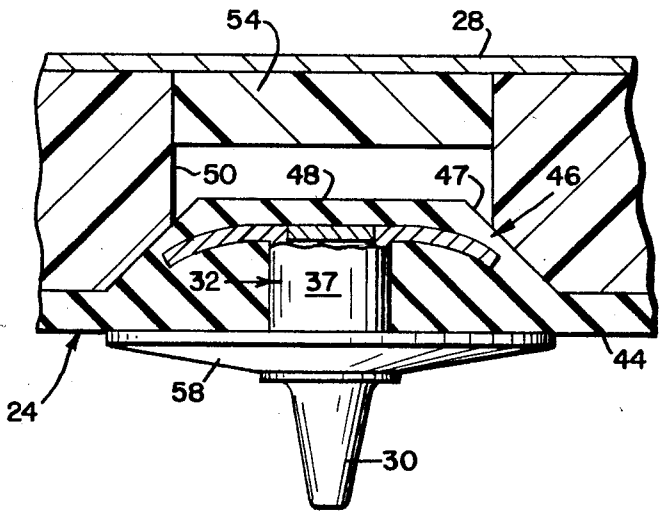
FIG. 8 is a section similar to FIG. 3, but showing yet another embodiment of this invention.

In the embodiment shown in FIG. 8, plugs 54 are also formed from a compressible, foamed polymeric material which is preferably of the closed cell type and which preferably is softer than midsole 26.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A golf shoe comprising a deformable flexible outsole having a ground engaging lower surface and an upper surface, an intermediate compressible sole structure overlying and attached to said upper surface of said outsole, spaced apart capsule portions formed in said outsole and projecting upwardly from said upper surface of said outsole, a set of spaced apart spike receptacles embedded in said outsole and encapsulated in said capsule portions, and ground engaging spikes fastened in said receptacles, said sole structure having a plurality of voids lying vertically above said capsule portions of said outsole, said capsule portions projecting upwardly into said voids from said upper surface of said outsole and moving at least partially into said voids from a normal position when the spikes encounter a hard surface to relieve the pressure points which are exerted on the wearer's foot and thereafter resuming said normal position.

2. The golf shoe defined in claim 1 wherein said capsule portions terminate in upwardly facing end faces, and wherein said voids are at least as large as and receive said end faces.

3. The golf shoe defined in claim 2 wherein said voids axially align with said capsule portions and said receptacles.

4. The golf shoe defined in claim 3 wherein said sole structure comprises at least one layer formed from a compressible foamed polymeric material, wherein said voids are formed in said layer, wherein each of said capsule portions is formed with a sloped side wall, and wherein the bottom edges of said voids are defined by said compressible layer and are precompressed against the sloped side walls of said capsule portions, and wherein the heights of said voids are sufficiently greater than the heights of said capsule portions that said end faces remain out of engagement with said layer upon compression of the layer under the wearer's load.

5. The golf shoe defined in claim 4 wherein each of said voids has a diameter greater than said end faces, but smaller than the base diameter of said capsule portions at the upper surface of said base portion.

6. The golf shoe defined in claim 4 including an insole board overlying said sole structure.

7. The golf shoe defined in claim 2 wherein said sole structure comprises upper and lower separately formed layers, each of said layers being formed from a compressible foamed polymeric material, said voids being formed in said lower layer.

8. The golf shoe defined in claim 7 wherein each capsule portion is tapered and is formed with a sloped side wall lying in a conical envelope, wherein the bottom edges of said void at the bottom of said lower layer are precompressed against the sloped side walls of said capsule portions, and wherein the heights of said voids are sufficiently greater than the heights of said capsule portions that said end faces remain out of engagement with said layers upon compression of said layers under the wearer's load.

9. The golf shoe defined in claim 8 wherein said lower layer is stiffer than said upper layer.

10. The golf shoe defined in claim 9 wherein the sum of the stiffnesses of said upper and lower layers is at least approximately equal to the sum of the stiffnesses of one of said capsule portions and said upper layer.

11. The golf shoe defined in claim 9 wherein said voids are formed through said lower layer, and wherein said upper layer closes the upper ends of said voids.

12. The golf shoe defined in claim 1 wherein said sole structure is formed as one piece from a compressible foamed polymeric material.

13. The golf shoe defined in claim 12 wherein each of said capsule portions is tapered and formed with a sloped side wall lying in a conical envelope, wherein the bottom edges of said voids are precompressed against the sloped side walls of said capsule portions, and wherein the heights of said voids are sufficiently greater than the heights of said capsule portions that said end faces remain out of engagement with said sole structure upon compression of the sole strucure under the wearer's load.

14. The golf shoe defined in claim 13 wherein said voids are formed only partially through said sole structure.

15. The golf shoe defined in claim 13 wherein said voids are formed completely through said sole structure to open at the top and bottom surfaces thereof, and wherein plugs are received in the upper ends of said voids to close the upper ends of the voids.

16. The golf shoe defined in claim 15 wherein said plugs are formed from a compressible closed cell polymeric material which is softer than said sole structure.

* * * * *